US008052068B1

(12) United States Patent
Renneckendorf et al.

(10) Patent No.: US 8,052,068 B1
(45) Date of Patent: Nov. 8, 2011

(54) GUIDE PLATE FOR LATERALLY GUIDING A RAIL AND SYSTEM FOR FASTENING A RAIL TO A BASE

(75) Inventors: Volker Renneckendorf, Lüdenscheid (DE); Thomas Dörfler, Creglingen (DE)

(73) Assignees: Vossloh-Werke GmbH, Werdohl (DE); Wirthwein GmbH & Co. KG, Creglingen (DE)

( * ) Notice: Subject to any disclaimer, the term of this patent is extended or adjusted under 35 U.S.C. 154(b) by 0 days.

(21) Appl. No.: 12/776,663

(22) Filed: May 10, 2010

(30) Foreign Application Priority Data

May 10, 2010 (EP) ..... 10162422

(51) Int. Cl.
*E01B 9/00* (2006.01)

(52) U.S. Cl. ..... 238/349; 238/351; 238/310; 238/338

(58) Field of Classification Search ..... 238/349, 238/351, 310, 338, 342, 343, 344, 345, 347, 238/366

See application file for complete search history.

(56) References Cited

U.S. PATENT DOCUMENTS

| | | | | | |
|---|---|---|---|---|---|
| 3,206,123 | A | * | 9/1965 | Baker | 238/349 |
| 3,870,231 | A | * | 3/1975 | Toyama et al. | 238/324 |
| 4,066,212 | A | * | 1/1978 | Sonneville | 238/349 |
| 4,078,724 | A | * | 3/1978 | McCormick et al. | 238/351 |
| 4,109,860 | A | * | 8/1978 | Serafin et al. | 238/349 |
| 4,111,361 | A | * | 9/1978 | Sonneville | 238/338 |
| 4,274,582 | A | * | 6/1981 | Fee | 238/349 |
| 4,349,151 | A | * | 9/1982 | Schumaker | 238/349 |
| 4,353,503 | A | * | 10/1982 | Duchemin | 238/349 |
| 4,447,006 | A | * | 5/1984 | Matsuo | 238/341 |
| 4,513,912 | A | * | 4/1985 | Schumaker | 238/349 |
| 4,632,308 | A | * | 12/1986 | Fischer | 238/265 |
| 4,705,215 | A | * | 11/1987 | Eisenberg et al. | 238/349 |
| 5,022,584 | A | * | 6/1991 | Sherrick | 238/282 |
| 5,125,573 | A | * | 6/1992 | Vanotti | 238/351 |
| 5,735,458 | A | * | 4/1998 | Brown et al. | 238/343 |
| 6,257,495 | B1 | * | 7/2001 | Eisenberg | 238/349 |
| 2005/0258265 | A1 | * | 11/2005 | Wirthwein et al. | 238/382 |
| 2008/0093472 | A1 | * | 4/2008 | Hohne et al. | 238/351 |
| 2008/0237363 | A1 | * | 10/2008 | Hauschild et al. | 238/349 |
| 2008/0257972 | A1 | * | 10/2008 | Vorderbruck et al. | 238/331 |
| 2009/0084864 | A1 | * | 4/2009 | Bosterling et al. | 238/349 |
| 2010/0200666 | A1 | | 8/2010 | Bosterling et al. | |

FOREIGN PATENT DOCUMENTS

| | | | |
|---|---|---|---|
| DE | 202007018500 | U1 | 9/2008 |
| DE | 202009004399 | U1 | 7/2009 |
| EP | 1914346 | A1 | 4/2008 |

* cited by examiner

*Primary Examiner* — Joe Morano, IV
*Assistant Examiner* — Jason C Smith
(74) *Attorney, Agent, or Firm* — The Webb Law Firm

(57) ABSTRACT

The invention relates to a guide plate for laterally guiding a rail S for rail vehicles to be fastened to a base 2 by means of a spring element 13 having a front face, against which the rail S is supported in the mounting position, and having an insulator element 19 which can be placed onto the foot F of the rail to be fastened, via which insulator element 19 the spring element 13 in the mounting position acts on the foot F of the rail S. The invention also relates to a system for fastening a rail, which comprises such a guide plate 3. In order to simplify mounting and to ensure reliable, correct positioning of the insulator element even under unfavourable mounting conditions, the invention makes provision for the insulator element 19 to be mounted on the guide plate 3 so that it can pivot.

12 Claims, 4 Drawing Sheets

GUIDE PLATE FOR LATERALLY GUIDING A RAIL AND SYSTEM FOR FASTENING A RAIL TO A BASE

The invention relates to a guide plate for laterally guiding a rail for rail vehicles to be fastened to a base by means of a spring element. The guide plate has a front face, against which the rail is supported in the mounting position, and supports an insulator element which can be placed onto the foot of the rail to be fastened, via which insulator element the spring element in the mounting position acts on the foot of the rail.

The invention also relates to a system for fastening a rail to a base, which comprises a guide plate, a spring element, which when the system is fully mounted exerts a retaining force on the rail via at least one spring arm, an insulator element, which when the system is fully mounted sits between the end of the spring arm assigned to the rail and the rail, so that the spring element acts on the rail via the insulator element, and a tensioning element for tensioning the spring element.

A guide plate and a fastening system of the previously mentioned type are known from DE 20 2009 004 399 U1. In the known system the guide plate supports, on its front face assigned to the rail to be fastened, an insulator element extending parallel to the front face for applications in which the rail is required to be heavily electrically insulated or in which, due to the use of non-insulating anchoring in the respective base, separate insulation for the rail is necessary. When the system is fully mounted this insulator element sits on the foot of the rail to be fastened such that the spring element exerting the retaining force acts on the rail via the insulator element. In this way, the rail is insulated against the conductive elements of the rail fastening system.

In order to simplify mounting of the known system so that it can be reliably handled by mounting machines operating automatically, the insulator element is securely connected to the guide plate. The secure connection of the insulator element has the additional advantage that the insulator element is held captive on the guide plate and loose components in the construction area are avoided.

So that the insulator element can follow the movements of the rail and the spring element despite the secure connection between insulator element and guide plate, without impairing the retaining force exerted by the spring element, a pre-determined breaking point is provided between the insulator element and the guide plate in the transition area, which breaks if a specific load is exceeded when the spring element is tensioned.

For certain applications, the previously explained secure arrangement of the insulator element on the guide plate is problematical in view of the fact that the insulator element protrudes in the direction of the space which in the fully mounted state is taken up by the rail to be fastened. Thus, existing rail fastening systems with the aid of the known combination of guide plate and insulator element can be modernised in a particularly simple way if no new rail is to be mounted. However, the known guide plates with the insulator elements securely fastened to them cannot be used for mounting new rails. Mounting of a new rail carried out with minimum effort firstly requires the guide plates and other components, provided at the respective fastening point, of the fastening systems used in each case, to be pre-mounted, subsequently the rail to be placed in the space delimited by the guide plates and then the fastening systems to be fully mounted. With such a procedure, an insulator element securely fastened to the guide plate would therefore protrude precisely into the space in which the rail is to be placed.

This problem does not exist if in a system for fastening a rail an insulator element is used which is designed in the manner known from DE 20 2007 018 500 U1. Here also, the insulator element is produced from an electrically non-conductive material. The insulator element has a receptacle into which an end section of a spring element positively fits which, when the system is fully mounted, exerts the required retaining force on the rail. In addition, the known insulator element has a bearing surface on its underside assigned to the rail foot. The insulator element is always reliably guided via this bearing surface when it is slid together with the spring element from a pre-mounting position arranged on the guide plate into the final mounting position onto the rail foot.

In mounting situations in which, due to the constructional factors or the mounting resources available in each case, it is not possible to already couple the insulator element in the previously described way durably to the respectively provided spring element during pre-mounting, the insulator elements must in each case be applied as discrete components between rail foot and tensioning clamp. Under the rough conditions prevalent in practice this generally proves to be difficult due to the limited size of the insulator element. Thus, it can happen when mounting takes place manually that the small insulator is forgotten by the rail mounter or is lost, without this being noticed. Moreover, when mounting automatically, elaborate manipulators must be provided in order to ensure that the insulator element is positioned correctly.

Against this background of the previously explained prior art, the object of the invention was to provide a guide plate and a system for fastening a rail, which can be mounted easily and which ensure that the insulator element is securely and correctly positioned even under unfavourable mounting conditions.

With regard to the guide plate, this object is achieved according to the invention by the guide plate having the features specified in Claim 1.

With regard to the system for fastening a rail, the above-mentioned object is achieved according to the invention by such a system being designed according to Claim 12.

Advantageous embodiments of the invention are specified in the dependent claims and will, like the general concept of the invention, be explained in detail below.

In accordance with the prior art specified at the beginning, a guide plate according to the invention for laterally guiding a rail for rail vehicles to be fastened to a base by means of a spring element has a front face, against which the rail is supported in the mounting position, and has an insulator element which can be placed onto the foot of the rail to be fastened, via which insulator element the spring element in the mounting position acts on the foot of the rail.

According to the invention, the insulator element is now mounted on the guide plate so that it can pivot. In this way, the insulator element is, on the one hand, fastened to the guide plate such that it is captive, so that, irrespective of whether the guide plate and the insulator element are mounted manually or automatically, it cannot be forgotten or lost. On the other hand, its pivotable arrangement according to the invention on the guide plate enables the insulator element to pivot without any difficulty from a pre-mounting position, in which it is positioned such that the space required for positioning the rail is free, into a mounting position, in which it sits on the rail foot.

Hence, with the invention, a guide plate and a correspondingly designed system for fastening a rail are available, with which even under unfavourable mounting conditions, at any time in a particularly simple way, positioning of the insulator element is ensured which meets the particular requirements.

Basically, the pivotable arrangement according to the invention of the insulator element on the guide plate can be achieved by any type of hinge which enables the insulator element to pivot from a pre-mounting position, in which the insulator element is arranged outside the space taken up by the rail to be fastened, into its final mounting position. A particularly practice-oriented, particularly simply manageable embodiment of the invention results if, with a guide plate according to the invention and a correspondingly designed system, the insulator element can be pivoted about a pivot axis aligned parallel to the front face of the guide plate. As the front face in each case runs parallel to the rail to be fastened, with the pivot axis aligned in this way the insulator element can be moved by means of a particularly simple pivot movement from the pre-mounting position into its final mounting position sitting on the rail foot. In this case, it is also easily possible for storing and transporting to pivot the insulator element combined with the guide plate into a position in which it is arranged in front of the front face of the guide plate. With an insulator element arranged in this storage position, the guide plate takes up a minimum height, without the insulator element having to be separated from the guide plate.

Depending on its form, the type of spring element to be used or the constructional factors, it can be advantageous to mount the insulator element in each case in only one mounting on the guide plate. A particularly robust mounting is produced, however, if the insulator element is mounted so that it can pivot about two pivot bearings. This applies in particular if the insulator element is used in combination with a W-shaped tensioning clamp used as a spring element, the spring arms of which in each case act together on the rail via the insulator element.

As guide plates of the type in question here are designed mirror-symmetrically in relation to a centre axis aligned normally to its front face, a particularly advantageous form of the guide plate results if the pivot axes of the pivot bearings are aligned coaxially to each other, thus the pivot bearings can also be arranged symmetrically to the respective centre axis.

The pivotable arrangement of the insulator element on the guide plate can, for example, be achieved by the insulator element having at least one pivot arm on which a bearing element is formed which together with a correspondingly shaped bearing element of the guide plate forms a pivot bearing for the insulator element. The one bearing element can be a pin and the other bearing element can be a recess in which the pin is pivoted. Thereby the pin may be assigned to the guide plate and the recess to the insulator element. Of course, in terms of a kinematic reversal, a reversed arrangement of the bearing elements is possible. In order to permit a subsequent or automatic compensation of tolerances, for example between the final mounting position of the insulator element and the spring element, the respective recess can be formed as an elongated hole in which the pin is guided being able to twist and shift. In the case where the insulator element is mounted in two pivot bearings on the guide plate, the pivot arms of the insulator element can also be sufficiently resiliently formed for them to be able to spread apart for mounting on the guide plate.

The insulator element having an elongated basic shape and extending parallel to the front face of the guide plate provides an optimum form of the insulator element for the predominant number of applications today.

An embodiment which is on the one hand inexpensive and at the same time particularly favourable, both in terms of the insulating effect and in terms of its weight, results when the guide plate and the insulator element are produced from plastic. Guide plate and insulator element can in this case be produced in an injection moulding process in which preferably polyamide with glass fibre reinforcement is processed. In the case where the hinge present according to the invention between insulator element and guide plate is formed in the way previously explained by a combination of pin and receptacle, the hinge can be formed by a mould slide in the mould. This enables the component, composed of the guide plate and the insulator element, to be produced in one manufacturing step without further intermediate or mounting steps. The play produced between pin and recess of the hinge connection by the mould slide in this case contributes to tolerance compensation when the components are mounted at the construction site.

A further embodiment of the invention, which improves practical handling of the guide plate according to the invention, is characterised by at least one catch element being provided on which the insulator element is detachably held in the pre-mounting position. In the same way, at least one catch element can be provided on which the insulator element is held in a storage position in which the bearing element is located in a position arranged in front of the front face.

The invention will be explained in more detail below by means of exemplary embodiments. Schematically in each case:

Figure 1:
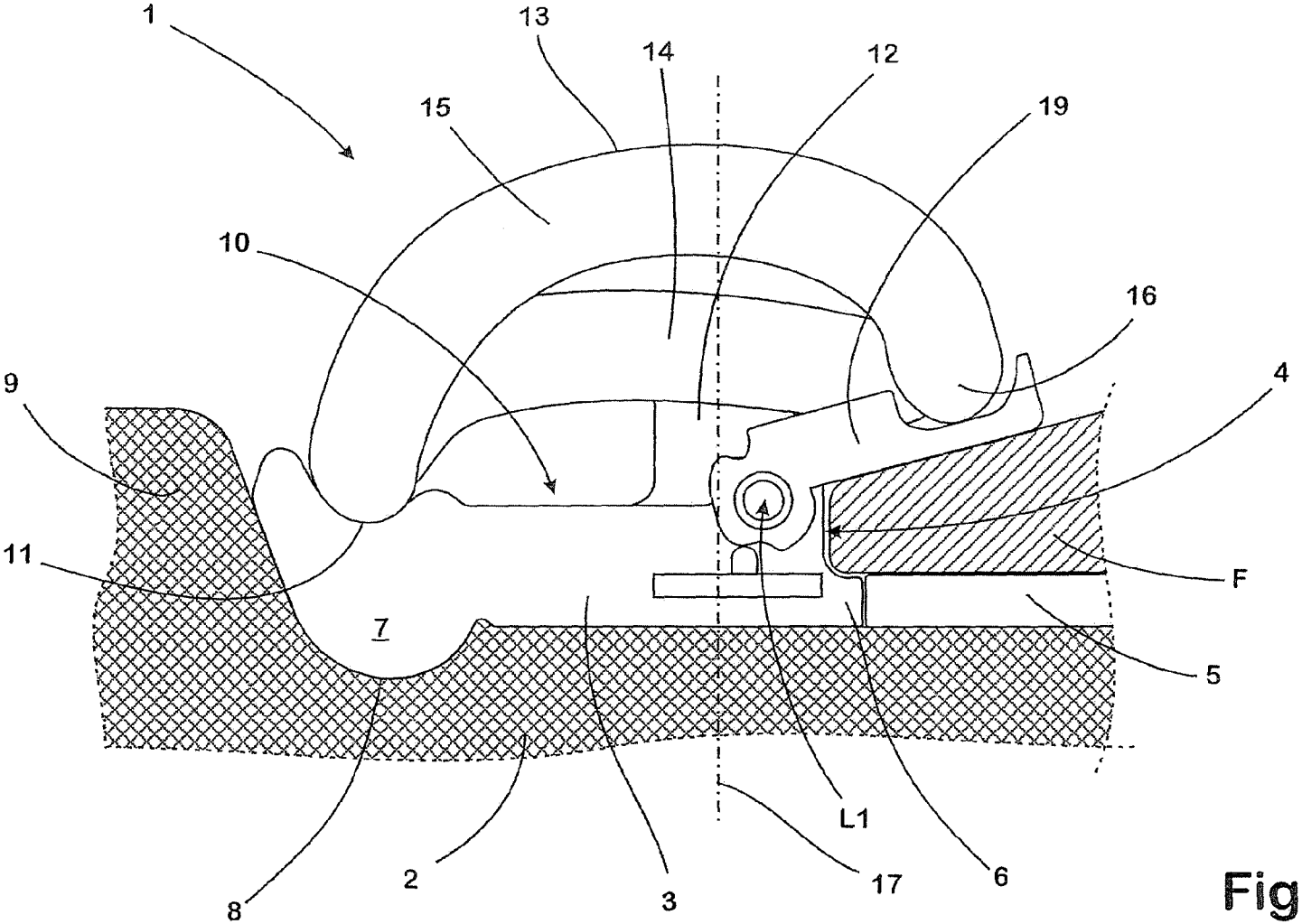
FIG. 1 shows a system for fastening a rail to a firm base, in a lateral, part-sectional view.

The system 1 shown in FIG. 1 for fastening a rail S to a base 2, formed for example by a concrete sleeper, comprises a guide plate 3 designed in the manner of a conventional angular guide plate, against the flat front face 4 of which the rail S is supported with the longitudinal side of its rail foot F.

The rail S, in a way which is also known per se, rests above a resilient intermediate layer 5 on the base 2. The resilient intermediate layer 5 ensures that there is sufficient flexibility in the rail S at the fastening point which is formed by the system 1 and a correspondingly constructed fastening system, arranged on the opposite side of the rail and not illustrated here.

On the lower edge of the front face 4 a protrusion 6 projecting in the direction of the rail S is formed on the guide plate 3, which extends across the width of the front face 4 and grips under the rail foot F when mounting is complete. The protrusion 6 in this way restricts the distance by which the rail S sinks when being travelled over by a rail vehicle not shown here.

On its rear side facing away from the front face 4, the guide plate 3 has an angular section 7, via which, on the one hand, the guide plate 3 is guided in a known way in a channel 8 formed into the base 2 and, on the other hand, is supported against a shoulder 9 formed on the base 2.

Shaped elements are formed on the free upper side 10 of the guide plate 3, such as a groove 11 extending parallel to the front face 4 and an elevation 12 arranged centrally and abutting onto the front face 4, which are used to guide a spring element 13 designed as a conventional W-shaped tensioning clamp. In the mounting position, the middle bend 14 of the spring element 13 is thereby guided on the elevation 12, while the respective transition between the middle bend 14 and one of the two spring arms 15 of the spring element 13 fits in the groove 11. When the system 1 is fully mounted, the spring element 13 exerts the required resilient retaining force on the rail foot F via its respective free end section 16.

To tension its spring element 13, the system 1 additionally has a tensioning element 17, designed for example as a conventional tensioning screw, which is guided through a through-hole formed into the guide plate 3 at a central point and reaching from the upper side 10 to the contact surface 18 resting on the base 2 and held in an anchoring which is embedded into the base 2 and is not illustrated here. For the sake of clarity, the tensioning element 17 is only indicated here by a dashed line.

An insulator element 19 is mounted on the guide plate 3 so that it can pivot. The insulator element 19 has an elongated form and extends parallel to the front face 4 across its entire width. A pivot arm 20, 21 is respectively formed onto the narrow end sides of the insulator element 19. The pivot arms 20, 21 are thereby formed in such a way that aligned essentially perpendicular to the insulator element 3 they laterally encompass the guide plate 3 in its region adjacent to the front face 4.

Figure 2:
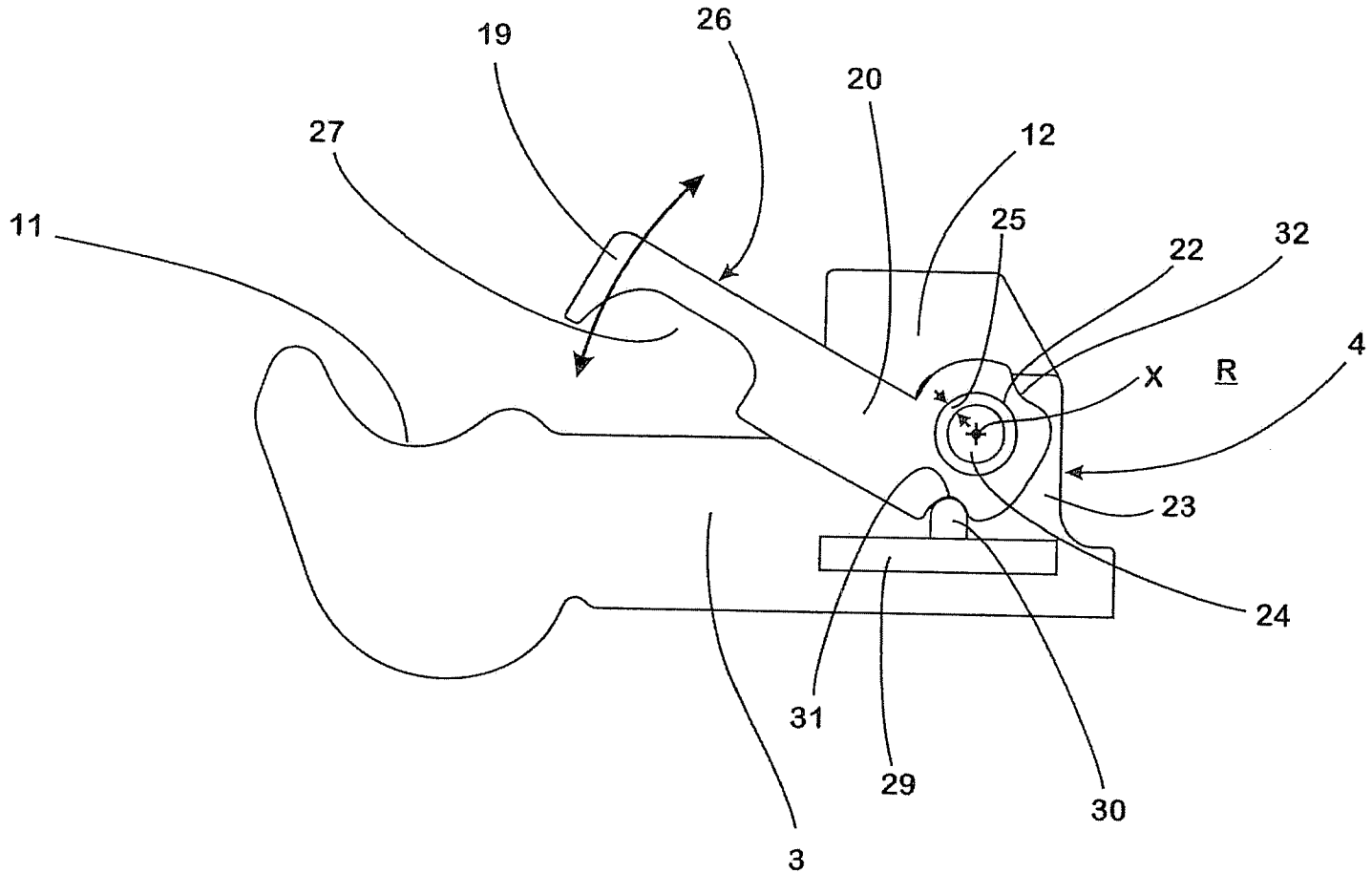
FIG. 2 shows a guide plate with an insulator element in a pre-mounting position, in a lateral view.
Figure 3:
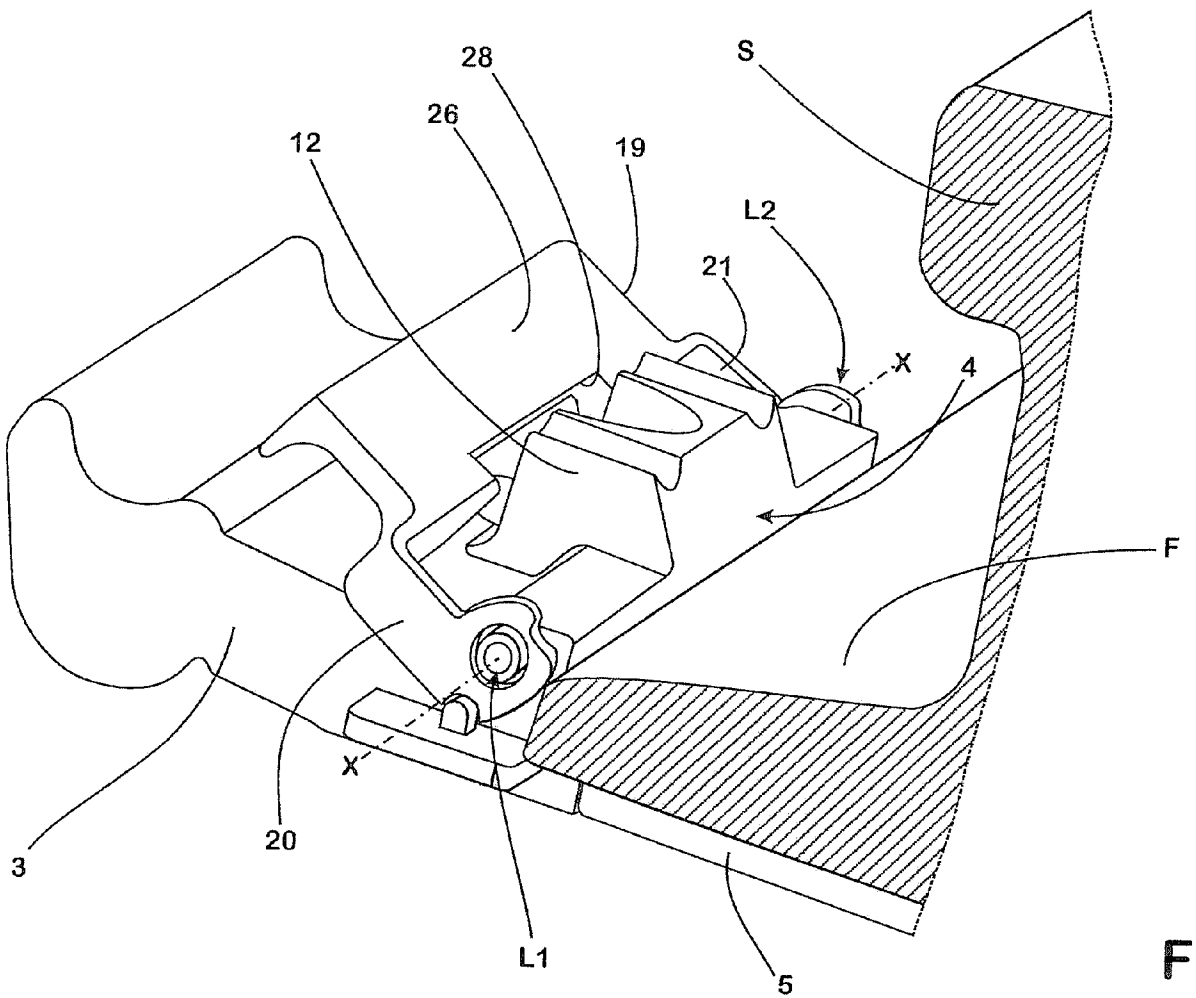
FIG. 3 shows the guide plate with the insulator element according to FIG. 1 in a pre-mounting state arranged on a rail, in a perspective view.

A recess 22 designed as a through-hole is present in the end sections of the pivot arms 20, 21 in each case, into which a pin 24, formed onto the guide plate 3 in its side section 23 adjacent to the front face 4 and laterally protruding outwards from the guide plate 3, grips. The outer diameter of the pin 24 is thereby by a specific undersize smaller than the inner diameter of the recess 22, so that a play 25 is available between pin 24 and recess 22 which is sufficient to compensate tolerances. The pins 24 and the respectively allocated recess 22 together form a pivot bearing L1, L2 in each case, about which the insulator element 19 can be pivoted. By means of the pins 24, aligned coaxially in relation to each other, a pivot axis X aligned parallel to the front face 4 is thereby defined, about which the insulator element 19 can be pivoted from a pre-mounting position, in which it is located above the upper side 10 of the guide plate 3 outside the space R required for positioning the rail S (FIG. 2), into its mounting position, in which it rests on the rail foot F with its bearing surface 26 (FIG. 1).

A receptacle 27, extending in the longitudinal direction of the insulator element 19 and parallel to the front face 4, is formed into the upper side of the insulator element 19, in which receptacle 27 the free ends of the spring arms 15 of the spring element 13 fit when the system 1 is fully mounted.

In order to eliminate the possibility of a collision with the elevation 12 of the guide plate 3 during pivoting, a recess 28 is formed into the longitudinal side of the insulator element 19 assigned to the elevation 12, the width and depth of this recess 28 being dimensioned such that the insulator element can be pivoted over the elevation 12 with sufficient play.

Figure 4:
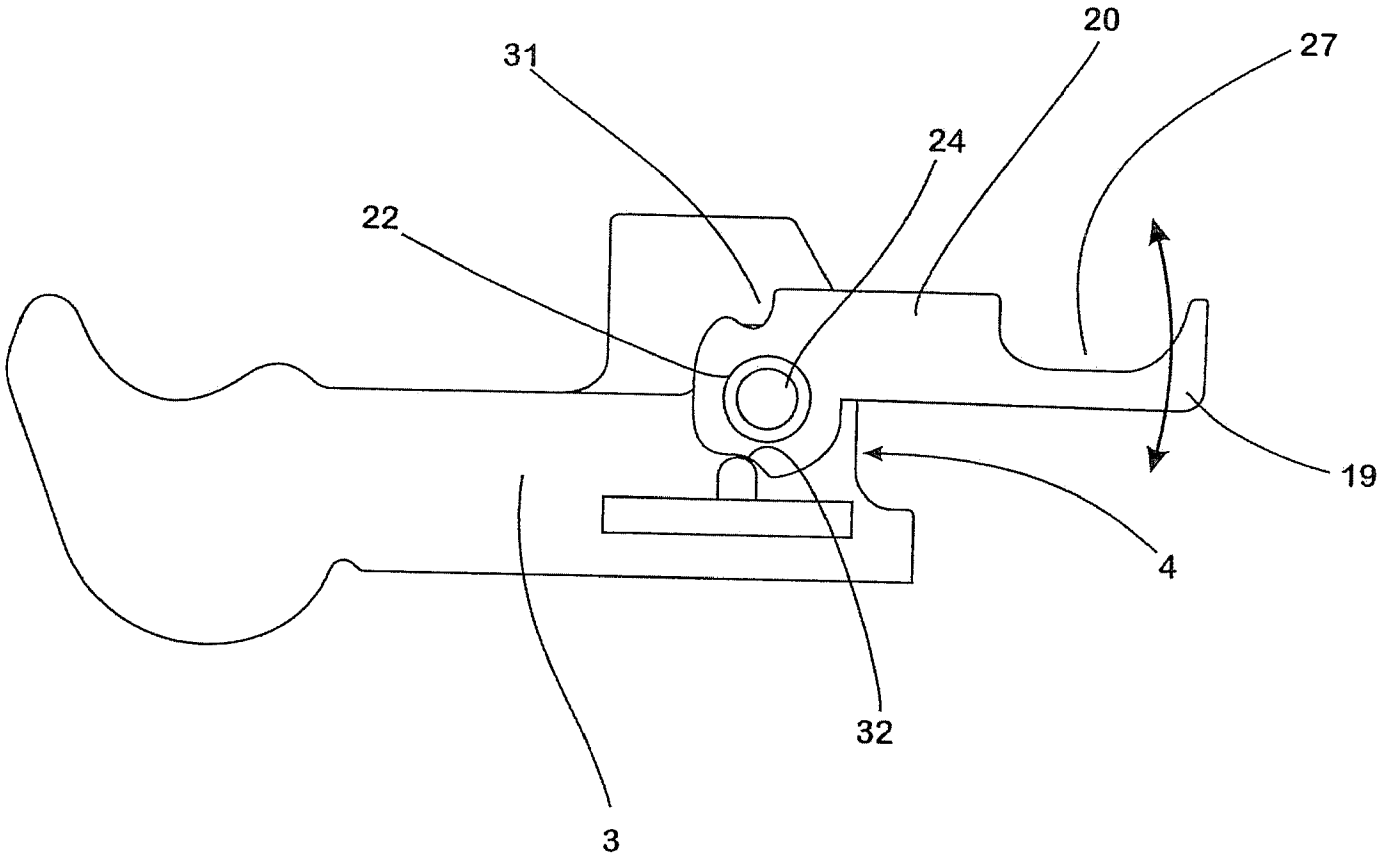
FIG. 4 shows the guide plate with the insulator element in a storage position provided for storage or transport, in a lateral view.

A shoulder 29 is formed in each case in the region of the side section 23 adjacent to the front face 4 of the guide plate 3 on both sides of the guide plate 3, which shoulder 29 supports a catch 30 protruding upwards. The catch 30 acts together with catch recesses 31, 32, which are formed on the periphery of the free end sections of the pivot arms 20, 21. The pre-mounting position is thereby in each case marked by one catch recess 31, while the other catch recess 32 indicates the final mounting position, in which the insulator element 19 rests on the rail foot F. The second catch recess 32 is formed such that it is big enough to permit the insulator element 19 to pivot as far as possible without any force over an angular range which is sufficient to be able to even correctly position the insulator element 19 on rail feet F of different thicknesses. The angular range is also sufficient to get the insulator element 19 into a storage position for storage and transport, in which it is arranged in front of the front face 4 of the guide plate 3 and its bearing surface 26 is aligned essentially parallel to the contact surface 18 of the guide plate 3 (FIG. 4). The catch recesses 31, 32 are thereby in each case formed such that the insulator element 19 can be easily moved out of the respective catch position by making use of the play 25 available in the region of the pivot bearings L1, L2.

REFERENCE SYMBOLS

1 System for fastening a rail S
2 Solid base (concrete sleeper)
3 Guide plate
4 Front face of the guide plate 3
5 Resilient intermediate layer
6 Protrusion of the guide plate 3
7 Angular section of the guide plate 3
8 Channel of the base 2
9 Shoulder of the base 2
10 Free upper side of the guide plate 3
11 Groove of the guide plate 3
12 Elevation of the guide plate 3
13 Spring element (tensioning clamp)
14 Middle bend of the spring element 13
15 Spring arm of the spring element 13
16 Free end section of the spring element 13
17 Tensioning element
18 Contact surface of the guide plate 13
19 Insulator element
20, 21 Pivot arm
22 Recess of the pivot arm 20
23 Side section of the guide plate 3
24 Pin of the guide plate 3
25 Play
26 Bearing surface of the insulator element 19
27 Receptacle of the insulator element 19
28 Recess of the insulator element 19
29 Shoulder of the guide plate 3
30 Catch of the guide plate 3
31, 32 Catch recesses of the pivot arm 20
F Rail foot of the rail S
L1, L2 Pivot bearings
R Space required for positioning the rail S
S Rail
X Common pivot axis of the pivot bearings L1, L2

The invention claimed is:

1. A guide plate for laterally guiding a rail for rail vehicles to be fastened to a base by means of a spring element, the guide plate having a front face, against which the rail is supported in a mounting position, and having an insulator element which can be placed onto the foot of the rail to be fastened, wherein the spring element, in the mounting position, acts on the foot of the rail, via the insulator element, and wherein the insulator element is mounted on the guide plate, the insulator element being freely pivotable about the guide plate from a pre-mounting position to a mounting position.

2. The guide plate according to claim 1, wherein the insulator element can be pivoted about a pivot axis aligned parallel to the front face of the guide plate.

3. The guide plate according to claim 1, wherein the insulator element is mounted so that it can pivot about two pivot bearings.

4. The guide plate according to claim 3, wherein pivot axes of the pivot bearings are coaxially aligned.

5. The guide plate according to claim 1, wherein the insulator element has a pivot arm that includes a first bearing element, which together with a correspondingly shaped second bearing element of the guide plate, forms a pivot bearing for the insulator element.

6. The guide plate according to claim 5, wherein the second bearing element is a pin and the first bearing element is a recess in which the pin is pivoted.

7. The guide plate according to claim 6, wherein the recess is an elongated hole opening.

8. The guide plate according to claim 1, wherein the insulator element has an elongated basic shape and extends parallel to the front face of the guide plate.

9. The guide plate according to claim 1, wherein the guide plate and the insulator element are produced from plastic.

10. The guide plate according to claim 1, wherein at least one catch element is provided, on which the insulator element is detachably held in a pre-mounting position.

11. The guide plate according to claim 1, wherein at least one catch element is provided, on which the insulator element is held in the mounting position, in which the insulator element is located in a position arranged in front of the front face.

12. A system for fastening a rail to a base, comprising a guide plate, a spring element, which when the system is fully mounted exerts a retaining force on the rail via at least one spring arm, an insulator element, which when the system fully mounted sits between an end of the spring arm assigned to the rail and the rail, so that the spring element acts on the rail via the insulator element, and a tensioning element for tensioning the spring element, wherein the insulator element is held on the guide plate, the insulator element being freely pivotable about the guide plate from a pre-mounting position to a mounting position.

* * * * *